United States Patent [19]

Patrichi et al.

[11] Patent Number: 4,860,698

[45] Date of Patent: Aug. 29, 1989

[54] PYROTECHNIC PISTON DEVICE

[75] Inventors: Mihai D. Patrichi, Los Angeles; Delbert L. Evanson, Mission Hills, both of Calif.

[73] Assignee: Networks Electronic Corp., Chatsworth, Calif.

[21] Appl. No.: 193,267

[22] Filed: May 11, 1988

[51] Int. Cl.[4] ..... F01B 29/08; F02N 13/00

[52] U.S. Cl. ..... 123/24 R; 60/635

[58] Field of Search ..... 123/23, 24 A, 24 R; 60/635, 636

[56] References Cited

U.S. PATENT DOCUMENTS

| | | | |
|---|---|---|---|
| 2,132,148 | 10/1938 | Davis | 140/113 |
| 2,742,697 | 4/1956 | Gross | 30/228 |
| 2,815,008 | 12/1957 | Hirt | 123/24 |
| 2,897,799 | 8/1959 | Stupian | 123/24 |
| 2,924,147 | 2/1960 | Bohl et al. | 89/1 |
| 2,942,818 | 6/1960 | Scott | 244/150 |
| 2,965,078 | 12/1960 | Chesnut et al. | 123/24 |
| 3,111,808 | 11/1963 | Fritz | 60/26.1 |
| 3,119,302 | 1/1964 | Barr | 89/1 |
| 3,199,288 | 8/1965 | Nahas | 60/26.1 |
| 3,234,727 | 2/1966 | Filer | 60/26.1 |
| 3,393,605 | 7/1968 | Parnell | 89/1 |
| 3,530,759 | 9/1970 | Francis | |
| 3,766,979 | 10/1973 | Patrick | |
| 3,888,085 | 6/1975 | Larsonneur | 60/635 |
| 4,091,621 | 5/1978 | Patrich | 60/635 |

*Primary Examiner*—David A. Okonsky

*Attorney, Agent, or Firm*—Richard L. Gausewitz

[57] ABSTRACT

A pyrotechnic piston device the housing of which has a cylindrical internal wall in which is mounted a piston. A pyrotechnic device is disposed adjacent the piston. A metal-to-metal seal is formed between the piston and the cylindrical wall to prevent blow-by of products of the explosion. Two types of constructions are provided to prevent bounce-back of the piston after it has reached the forward end of its stroke.

9 Claims, 2 Drawing Sheets

PYROTECHNIC PISTON DEVICE

BACKGROUND OF THE INVENTION

There is a major need for a pyrotechnic piston device, such as a piston actuator, that will have a very long shelf life, that will not be plagued by the problem of blow-by, that maintains the piston in the full-forward position after firing, that is highly effective and reliable, and that is relatively simple and economical to manufacture.

Referring, for example, to shelf life, this is of great importance in many fields, but especially to the military. It is intolerable if the effectiveness of a seal between the piston and the cylinder degrades with time. Such degrading coul cause a malfunction of a crucial component in a missile, for example. Thus, O-rings and other rubber or synthetic resin seal elements are unsatisfactory and often totally unacceptable.

When a seal between the piston and the cylinder degrades, there is blow-by of gaseous and other products of the explosion. Such products pass by the piston, emanate from the cylinder, and may cause severely adverse effects. Furthermore, the blow-by reduces the amount of force that is exerted on the piston.

Even when an O-ring, or other seal formed of rubber or synthetic resin, is new and not at all degraded, there may be blow-by because of the heat and pressure effects that the pyrotechnics exert on (for example) an O-ring.

Referring next to one of the major factors other than shelf life and blow-by, it is essential in piston actuators that the load against which the piston works not cause the piston to bounce back into the cylinder, either wholly or partially. Thus, effective means must be provided to prevent such rebound.

In addition to the above-mentioned factors, there are the ever-present problems of production cost, reliability, effectiveness, simplicity, etc. A truly excellent pyrotechnic piston device must satisfy all of these requirements besides overcoming the problems of shelf life, blow-by and rebound.

SUMMARY OF THE INVENTION

The present pyrotechnic piston device has a particular metal-to-metal seal to effectively prevent blow-by. The seal employs certain pressure points or regions to ensure that products of the explosion do not emanate from the cylinder.

There are also secondary seal points or regions, one being on the barrel of the piston.

There is no need for any O-ring or other piston seal formed of rubber or synthetic resin. Thus, shelf life cannot result in degradation of the seal between piston and cylinder.

A pyrotechnic assembly is provided, having a combination powder-holding and piston-insertion component. The housing is crimped around such component, and a cap is provided.

In one form of the combination, the same gas pressure that achieves the metal-to-metal seal also creates a positive lock further assuring that there can be no rebound.

DETAILED DESCRIPTION OF THE PREFERRED EMBODIMENTS

The pyrotechnic piston device may have a wide variety of sizes. Often, however, the size is very small. For example, the housing may be less than an inch long.

The illustrated pyrotechnic piston device is a piston actuator. It is to be understood, however, that other types of devices, for example cutters, may be provided.

Figures 1, 2, 3A, 3B:
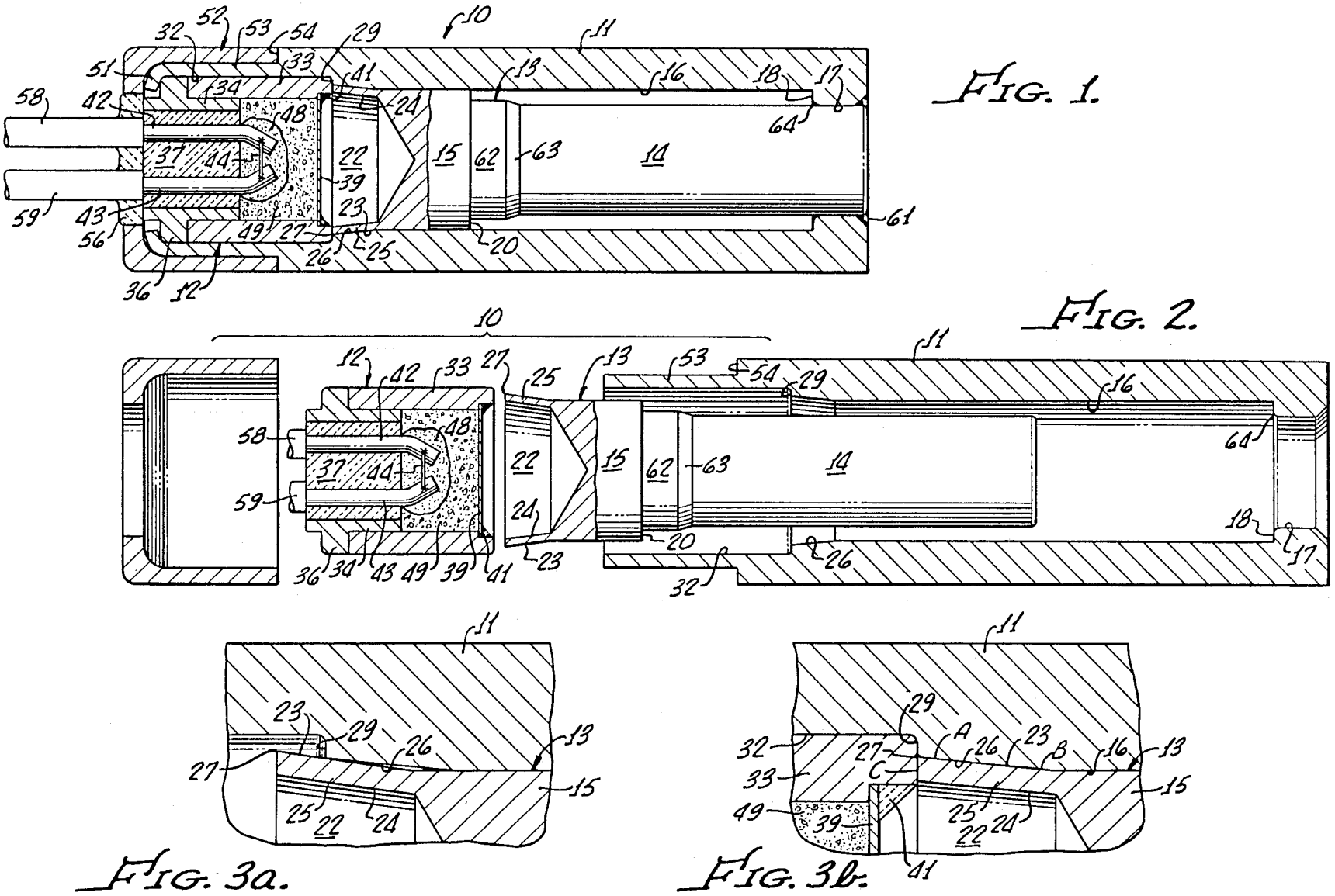
FIG. 1 is a longitudinal central sectional view of a pyrotechnic piston device incorporating the present invention, in fully-assembled condition ready to fire.
FIG. 2 is a partially exploded view illustrating the assembly of the device.
FIG. 3*a* is an enlarged fragmentary longitudinal sectional view showing an upper-left portion of the showing of FIG. 1, just prior to full assembly of the piston into the cylinder.
FIG. 3*b* corresponds to FIG. 3*a* but illustrates the condition after full assembly.

Referring to FIG. 1, the pyrotechnic piston device comprises an elongate housing 10 the majority of which consists of a cylinder portion 11. The remainder of housing 10, at the left end thereof as viewed in FIG. 1, comprises a portion that encloses a combination pyrotechnic and piston-insertion means 12.

An elongate piston 13, having a barrel portion 14 and a head 15, is mounted coaxially in cylinder portion 11 of the housing. The piston 13, housing 10 and other components of the pyrotechnic piston device are all generally cylindrical, so that a section taken in any plane containing the axis of the device would look like every other section taken in any plane containing such axis. The only exception relates to the leads (and associated passages) employed to detonate the explosive as described subsequently.

Except at the forward and rear ends of cylinder portion 11, the interior surface of such portion 11 is a cylindrical surface 16 having a constant diameter that is substantially greater than the diameter of barrel portion 14. The forward end of cylinder portion 11 is inwardly flanged, and has a cylindrical interior surface 17 that engages the exterior cylindrical surface of barrel portion 14 at the forward end thereof (FIG. 1).

At such forward barrel end, and at the great majority of the length of barrel portion 14, the surface 17 is a close but sliding fit with the barrel surface. At the junction between the main body of cylinder portion 11 and the inwardly-flanged forward end thereof, there is a generally radial shoulder 18.

Figure 4:
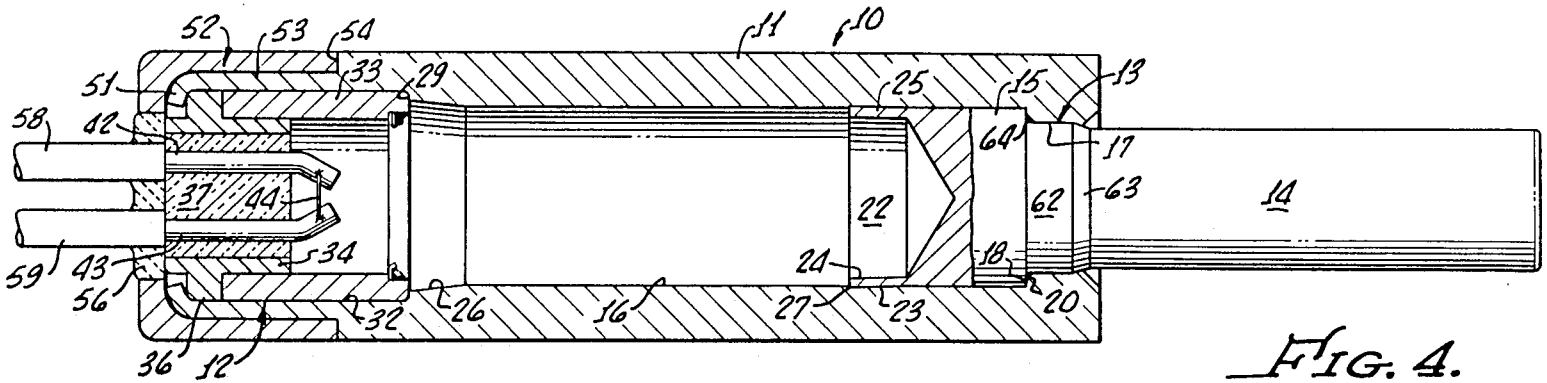
FIG. 4 is a view illustrating the condition of the device after firing thereof.

The head 15 of the piston has a radial forward surface 20 that encompasses the barrel portion, such surface 20 being adapted to engage shoulder 18 after firing of the device, reference being made to FIG. 4. Thus, the distance from surface 20 to shoulder 18 determines the distance that the piston barrel 14 will shift forwardly upon firing of the device.

Head 15 is preferably solid at the forward portion thereof, just as the barrel 14 is preferably solid, but the rear of the head is hollow—there thus being a chamber 22 formed therein. Furthermore, while the exterior surface of the solid forward portion of head 15 is cylindrical and is a close but sliding fit relative to cylinder surface 16, the exterior surface of the rear portion of head 15 is substantially frustoconical and rearwardly divergent. Such rear surface is numbered 23, and is parallel or concentric with an interior head surface 24 that is likewise frustoconical and rearwardly divergent.

Head surfaces 23 and 24 are sufficiently close to each other, that is to say that the wall thickness at the rear of head 15 is sufficiently thin, that the generally frustoconical rear end 25 of head 15 will flex as the piston 13 moves forwardly. The material forming the piston is tempered steel, so that such rear end 25 may flex without exceeding its elastic limit and taking a permanent set. Accordingly, and because of the gas pressure present within chamber 22, exterior surface 23 closely hugs the interior surface of cylinder portion 11 at all times while the piston strokes forwardly.

At its rear end, interior barrel surface 16 flares outwardly and rearwardly at an angle (to the horizontal) slightly less than that of surfaces 23 and 24. Preferably, such flaring of the rear interior wall of cylinder portion 11 commences at the region where the thin-walled rear end 25 of head 15 engages the solid forward portion of such head. The rearwardly divergent interior surface of the cylinder 11, at the left end thereof, is numbered 26.

The exterior rear edge of the end 25 of the head is a sharp corner 27, throughout the entire circular periphery of the head.

When piston 13 is in fully-inserted position in cylinder portion 11 of the housing 10, as shown in FIG. 1, the forward end of barrel 14 is preferably flush with the forward end of the housing. At this time, corner or edge 27, and the entire radial rear surface of head end 25, are flush with a radial interior wall 29 of the housing 10, as shown in FIG. 3*b*. Wall 29 extends outwardly to a cylindrical wall 32 that is formed in the housing and that has a diameter substantially larger than that of the rear end of surface 26. Wall 32 defines a cylindrical bore or chamber, in the rear end of housing 10, adapted to receive the combination pyrotechnic and piston-insertion means 12.

The pyrotechnic and piston-insertion means 12 comprises forward and rear hollow cylinders 33 and 34, respectively, that are in close-fitting and partially-telescoped relationship relative to each other. Rear cylinder 34 has a thick radial flange 36 the outer diameter of which is the same as that of forward cylinder 33, which in turn is only slightly less than the diameter of surface 32. Flange 36 determines the amount of partial telescoping of rear cylinder 34 into forward cylinder 33. The wall thickness of rear cylinder 34 is substantially less than that of forward cylinder 33 into which it is telescoped, the relationships being such that radial flange 36 operates somewhat in the nature of a rearward extension of forward cylinder 33.

A cylinder 37, formed of glass, is inserted closely into rear cylinder 34, the outer surface of glass cylinder 37 being bonded to the inner surface of such rear cylinder 34. The forward surfaces of cylinders 37 and 34 lie in a common plane, and define the rear wall of a powder chamber containing the pyrotechnic or explosive substance. The sidewall of such chamber is the inner surface of forward cylinder 33, while the forward wall of the chamber is a seal element 39 that may, for example, be a thin disc of mylar. The mylar is seated peripherally in the bottom of a counterbore formed in the forward end of cylinder 33, the diameter of the counterbore being substantially equal to the diameter of interior surface 24 at the rear end of head 15. The mylar is held in position by an adhesive such as epoxy, for example, and which is shown at 41.

Two electrode wires 42,43 are extended forwardly through the glass cylinder 37, in sealed relationship, the forward ends of the wires extending into the powder chamber and being bent towards each other. A fine wire 44 is connected between the forward ends of electrode wires 42,43. Such wire 44 is adapted to become very hot, and thus ignite the powder, when voltage is applied to the electrode wires.

Preferably, the pyrotechnic substance in immediate contact with the forward ends of electrode wires 42,43, as well as with fine wire 44, is in the form of a solid mass 48, while the remainder of the powder is granular and is indicated at 49.

The force created by the explosion of powder 48,49 does not cause cylinders 34,37 to move rearwardly, because the rear end 51 of housing 10 is crimped or bent-over around the flange 36. In addition, there is provided around such crimped or bent end 51, as well as portions substantially forward thereof, a cap 52 which is generally cup-shaped. The cylindrical sidewall of cap 52 telescopes over a reduced-diameter rear portion 53 of housing 10, while the bottom wall of the cap 52 (left end in FIG. 1) engages the bent end 51. The wall thicknesses of the sidewall of the cap, and of the reduced diameter housing portion 53, are such that the cap in effect forms an extension of the housing—the cylindrical outer sidewall of the cap being flush with the cylindrical housing wall forward thereof.

Cap 52 is mounted on housing portion 53 by pressing it 15 thereon in interference-fit relationship until a radial shoulder 54 of the housing is engaged. Then, epoxy or other sealant, numbered 56, is provided in opening means in the bottom (left) wall of cap 52, around insulation 58,59 that respectively covers electrode wires 42,43. A sealant is also provided at the forward end of the barrel 14 of piston 13, as shown at 61 in FIG. 1. Such sealant 61 is in an annular groove at the extreme forward end of barrel 14, at a beveled portion of the inner flange at the forward end of housing 10.

THE METAL-TO-METAL SEALS, AND THE MEANS TO PREVENT BOUNCE-BACK

Because the rear end portion 25 of head 15 (FIG. 3*a*) is flared outwardly at a slightly greater angle than that of surface 26 of housing portion 11, when the piston 13 is pushed forwardly into the housing (until the extreme rear end of head 15 is flush with radial wall 29, as shown in FIG. 3*b*), there is an interference fit. Such interference fit is between edge 27—and the remainder of the thin-walled rear end 25—and surface 26 of the housing.

Stated otherwise, the combination pyrotechnic and piston-insertion means 12 is pressed or forced forwardly until the forward hollow cylinder 33 seats firmly on radial wall 29 of the housing, as shown in FIGS. 1 and 3*b*. Thus, the springy or resilient rear end portion 25 of head 15 is forced by surface 26 to have a diameter somewhat less large than its natural or free diameter. The pressing on the rear radial surface of end portion 25 of head 15 is maintained because of the above-described crimping or bending of end 51 around flange 36.

The result is that there are sealing pressures at at least three regions, which are indicated at A, B and C in FIG. 3*b*. The sealing pressure at A is a radial outward pressure between head end 25 and surface 26. The sealing at is between the adjacent junctions between the head and the housing. Stated otherwise, the sealing pressure at B is between the junction region where head end 25 connects to the solid forward portion of the head, and the region where the cylindrical surface 16 meets frustoconical surface 26. The sealing at C is between the forward end of forward hollow cylinder 33 and the adjacent radial surface of rear end 25 of the head.

When voltage is applied to electrode wires 42,43, so as to heat fine wire 44 and thus detonate powder 48,49, the instantaneous release of products of the explosion propels piston 13 forwardly as far as permitted by the shoulder 18 and surface 20. During this entire movement, rear end portion 25 of the head 15 remains in metal-to-metal interference-fit contact first with surface 26 and then with surface 16 of the housing 10. Corner or edge 27 of the head, and other portions of head end 25, are in close pressure engagement with the surfaces 26 and 16 not only because of the resilience of head end 25 but because of the very large gas pressure exerted by the products of the explosion.

After surface 20 of the piston engages shoulder 18 of the housing, bounce-back is prevented in two ways in the present embodiment. Firstly, corner or edge 27 digs somewhat into surface 16, thus acting to prevent rebound.

Secondly, there is an interference fit relationship created between the piston barrel 14 and the surface 17 at the forward end of housing 10. Such interference fit relationship is generated by causing the rear end of barrel 14 to be somewhat larger in diameter than the great majority of barrel 14. Such larger-diameter rear end portion of the barrel is indicated at 62. The transition between portion 62 and the barrel portion forwardly thereof is generally frustoconical, as indicated at 63. The junction between housing surface 17 and shoulder 18 is rounded or radiused, as shown in 64.

Thus, when frustoconical portion 63 engages rounded portion 64 there is the beginning of an interference fit relationship. Such relationship continues and augments until the larger diameter portion 62 is inserted fully into the interior flange at the forward end of housing 10. Stated otherwise, portions 62,63 are caused to be radially-inwardly of, and in interference-fit relationship with, surface 17 of the housing. This strong interference fit cooperates with edge or corner 27 of head 15 in preventing bounce-back or rebound.

In addition, the strong interference fit cooperates effectively with the above-described metal-to-metal seal between head end 25 and surface 16 in preventing any products of the explosion from emanating out the forward end of housing 10. The products of the explosion are thus contained effectively within the housing.

The interference fit created by portion 62 of the barrel also tends to buffer, somewhat, the stopping of the forward movement of the piston.

The high pressure generated within the housing, as the result of the explosion, tends strongly to blast cylinders 34,37 out the rear end of the housing, despite the crimping or bending at 51. However, because of the presence of cap 52 there is no such shifting of the cylinders 34,37. The flange 36, in trying to move rearwardly as the result of the explosion, co-acts with bent-over end 51 of the housing to create a binding relationship between the housing end and the cap 52 disposed therearound. Therefore, and because of the interference fit relationship between the cap and the housing created when the cap is mounted, the high pressure generated within the housing does not cause the cylinders 34,37 to shift.

Figure 5:
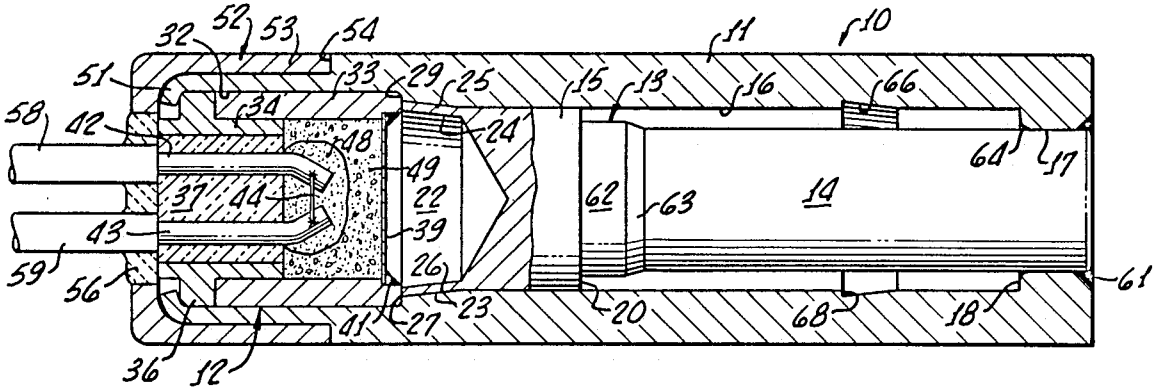
FIG. 5 is a view corresponding to FIG. 1 but illustrating a second embodiment of the invention, wherein additional means are provided to prevent rebound of the piston.
Figure 6:
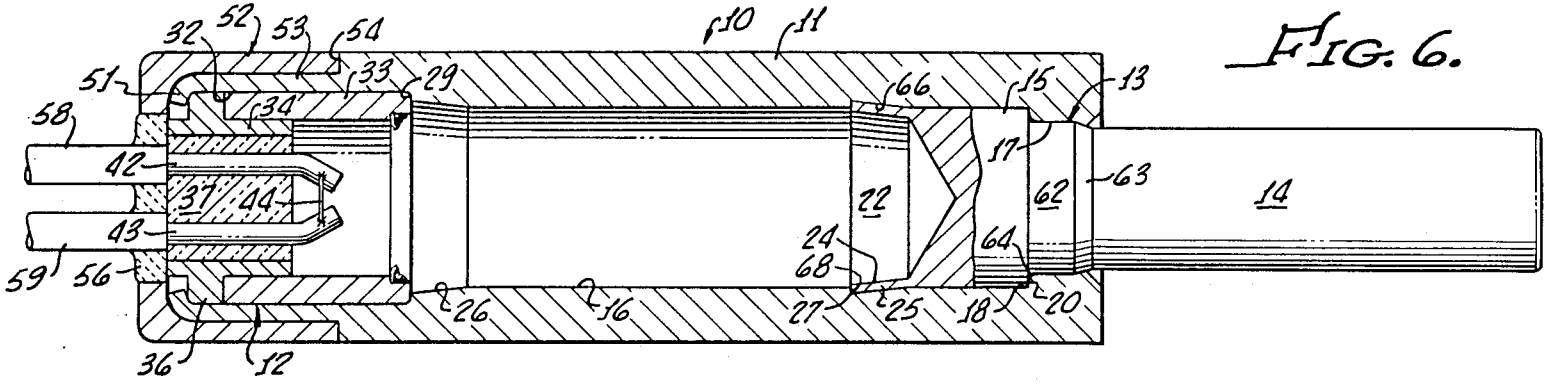
FIG. 6 is a view illustrating the condition of such second embodiment after firing.

EMBODIMENT OF FIGS. 5 and 6

FIGS. 5 and 6 correspond, respectively, to FIGS. 1 and 4, being identical thereto except relative to a groove provided in the interior surface of cylinder portion 11 of housing 10. The groove has a rearwardly-divergent frustoconical wall 66 which meets, at the rear end thereof, a radial shoulder 68. The groove and shoulder 68 are precisely positioned to receive the rear end 25 of piston head 15 when surface 20 of the piston meets shoulder 18 of the housing.

The head end 25 springs outwardly into the groove because of its own natural resilience and because of the very high pressure of the products of the explosion. This provides a positive lock, assuring that there can be no rebound of the piston 13 even when the loads tending to effect such rebound are especially high.

The foregoing detailed description is to be clearly understood as given by way of illustration and example only, the spirit and scope of this invention being limited solely by the appended claims

What is claimed is:

1. A pyrotechnic piston device, which comprises:

(a) an elongate housing having a cylinder portion therein, said cylinder portion having a cylindrical internal wall, said cylindrical internal wall communicating coaxially with a rearwardly divergent internal wall of said cylinder portion, (b) pyrotechnic means mounted in said housing and communicating with the end of said cylinder portion, said divergent wall being adjacnet said pyrotechnic means, (c) a piston mounted in said cylinder portion, said piston having a head at the inner end thereof, relatively adjacent said pyrotechnic means, and (d) means on said head to create an effective metal-to-metal seal between said head and said cylindrical interior wall during the stroke of said piston when said pistion is impelled by explosion of said pyrotechnic means, whereby to prevent blow-by of products of the explosion past said piston, said metal-to-metal seal means (d) comprising a head end portion relatively adjacent said pyrotechnic means, said end portion being hollow and being formed of springy metal, the chamber within said hollow end portion communicating with said pyrotechnic means, the edge of said head end portion closest to said pyrotechnic means engaging said cylindrical internal wall while said piston is impelled by the explosion, said end portion of said head being in resilient engagement with said cylindrical internal wall while said piston is impelled by the explosion, said end portion of said head being rearwardly divergent, said rearwardly divergent wall of said head being in engagement with said rearwardly divergent wall of said cylinder portion when said piston and housing are in fully assembled condition prior to the explosion.

2. A pyrotechnic piston device, which comprises:

(a) an elongate housing having a cylinder portion therein,
said cylinder portion having a cylindrical internal wall,
(b) pyrotechnic means mounted in said housing and communicating with the inner end of said cylinder portion,
(c) a piston mounted in said cylinder portion,
said piston having a head at the inner end thereof, relatively adjacent said pyrotechnic means,
said piston having a barrel portion coaxial with said head and substantially smaller in diameter than said said head,
said cylinder portion having an internal flange at the end thereof remote from said head,
said internal flange having a cylindrical passage therethrough the wall of which slideably receives said barrel portion,
said flange cooperating with the forward end of said head to limit the stroke of said piston,
the main portion of said barrel being a close but sliding fit in said cylindrical passage in said flange,
a portion of said barrel relatively adjacent said head having a diameter slightly larger than that of said main portion of said barrel,
said slightly-larger diameter being such that said barrel portion adjacent said head is an interference fit in said flange,
thereby preventing escape of products of the explosion from said housing, and thereby buffering the last part of the forward stroke of said portion so that the deceleration rate of said piston at the end of its stroke is reduced, and thereby preventing rebound of said piston, and
(d) means on said head to create an effective metal-to-metal seal between said head and said cylindrical interior wall during the stroke of said piston when said piston is impelled by explosion of said pyrotechnic means,
whereby to prevent blow-by of products of the explosion past said piston.

3. The invention as claimed in claim 2, in which the end portion of said head has a sharp exterior edge or corner at the end thereof adjacent said pyrotechnic means, said edge or corner digging into said cylindrical internal wall at the end of the piston stroke and thus cooperating to prevent rebound of said piston.

4. A pyrotechnic piston device, which comprises:
(a) an elongated housing having a cylinder portion therein,
said cylinder portion having a cylindrical internal wall,
said internal wall of said cylinder portion having a circular groove therin,
(b) pyrotechnic means mounted in said housing and communicating with the inner end of said cylinder portion,
(c) a piston mounted in said cylinder portion,
said piston having a head at the inner end thereof, relatively adjacent said pyrotechnic means, and
(d) means on said head to create an effective metal-to-metal seal between said head and said cylindrical interior wall during the stroke of said piston when said piston is impelled by explosion of said pyrotechnic means,
whereby to prevent blow-by of products of the explosion past said piston,
said metal-to-metal seal means (d) comprising an end portion relatively adjacent said pyrotehnic means,
said end portion being hollow,
the chamber within said hollow end portion communicating with said pyrotechnic means, the edge of said head end portion closest to said pyrotechnic means engaging said cylindrical internal wall while said piston is impelled by the explosion,
said groove being located to receive the end of said head closest to said pyrotechnic means,
said groove having a generally radial wall against which said head edge engages so as to positively lock said piston against rebound.

5. The invention as claimed in claim 2, in which said internal wall of said cylinder portion has a circular groove therein, said groove being located to receive the end of said head closest to said pyrotechnic means, said groove having a generally radial wall against which said head edge engages so as to positively lock said piston against rebound.

6. A pyrotechnic explosive device, which comprises:
(a) an elongate housing,
said housing having a cylinder portion adapted to receive a piston,
said cylinder portion having a cylindrical internal wall,
said housing also having a rear portion adapted to receive a combination pyrotechnic and piston-insertion means,
said rear portion having a cylindrical internal wall coaxial with said internal wall of said cylinder portion, and having a diameter substantially greater than that of said internal wall of said cylinder portion,
said housing also having an internal flange at the forward end thereof,
said flange having a cylindrical internal wall coaxial with both of said above-recited internal walls and having a diameter substantially smaller than that of said internal wall of said cylinder portion,
(b) a piston mounted in said housing,
said piston having a head disposed in said cylinder portion adjacent said rear portion,
said piston having a barrel disposed both in said cylinder portion and in said flange,
(c) means to provide a metal-to-metal seal between said head and said cylindrical internal wall of said cylinder portion during substantially all portions of forward movement of said piston,
said means (c) to provide a metal-to-metal seal between said head and said cylindrical internal wall of said cylinder portion comprising a seal portion of said head adjacent said combination pyrotechnic and piston-insertion means,
said seal portion being thin-walled and formed of springy metal,
said seal portion being in resilient engagement with the internal wall of said cylinder portion during the forward movement of said piston resulting from detonation of the explosive,
said seal portion being rearwardly divergent,
there being a rearwardly-divergent wall between said cylindrical interior wall of said cylinder portion and said cylindrical interior wall of said rear portion of said housing, said seal portion of said head having a somewhat larger external diameter, when said seal portion is in free condition, than the diameter of the rear end of said rearwardly-divergent wall of said cylinder portion, (d) a combination pyrotechnic and piston-insertion means mounted in said rear portion of said housing,
said combination pyrotechnic and piston-insertion means being adapted to push said head into said cylinder portion during assembly of the device,
said combination pyrotechnic and piston-insertion means containing an explosive and a means to detonate said explosive, and (e) means to prevent said combination pyrotechnic and piston-insertion means from moving rearwardly as the result of detonation of said explosive.

7. The invention as claimed in claim 6, in which said combination pyrotechnic and piston-insertion means has a cylindrical exterior wall, and is inserted into said rear portion of said housing until it engages the housing portion at the junction between said rear portion of said housing and said cylinder portion thereof, the head of said piston being forced into said cylinder portion of said housing by insertion of said combination pyrotechnic and piston-insertion means.

8. A pyrotechnic explosive device, which comprises:

(a) an elongate housing,
said housing having a cylinder portion adapted to receive a piston,
said cylinder portion having a cylindrical internal wall, said cylinder portion of said housing having an internal groove,
said internal groove having a generally radially rear wall,
said housing also having a rear portion adapted to receives a combination pyrotechnic and piston-insertion means,
said rear portion having a cylindrical internal wall coaxial with said internal wall of said cylinder portion, and having a diameter substantially greater than that of said internal wall of said cylinder portion,
said housing also having an internal flange at the forward end thereof,
said flange having a cylindrical internal wall coaxial with both of said above-recited internal walls and having a diameter substantially smaller than that of said internal wall of said cylinder portion, (b) a piston mounted in said housing,
said piston having a head disposed in said cylinder portion adjacent said rear portion,
said internal groove in said cylinder portion being sized to receive the rear end of said head when said piston is in full-forward position,
said piston having a barrel disposed both in said cylinder portion and in said flange, (c) means to provide a metal-to-metal between said head and said cylindrical internal wall of said cylinder portion during substantially all portions of forward movement of said piston, (d) a combination pyrotechnic and piston-insertion means mounted in said rear portion of said housing,
said combination pyrotechnic and piston-insertion means being adapted to push said head into said cylinder portion during assembly of the device,
said combination pyrotechnic and pistion-insertion means containing an explosive and a means to detonate said explosive, and (e) means to prevent said combination pyrotechnic and piston-insertion means from moving rearwardly as the result of detonation of said explosive.

9. A pyrotechnic explosive device, which comprises:

(a) an elongate housing,
said housing having a cylinder portion adapted to receive a piston,
said cylinder portion having a cylindrical internal wall,
said housing also having a rear portion adapted to receive a combination pyrotechnic and piston-insertion means,
said rear portion having a cylindrical internal wall coaxial with said internal wall of said cylinder portion, and having a diameter substantially greater than that of said internal wall of said cylinder portion,
said housing also having an internal flange at the forward end thereof,
said flange having a cylindrical internal wall coaxial with both of said above-recited internal walls and having a diameter substantially smaller than that of said internal wall of said cylinder portion, (b) a piston mounted in said housing,
said piston having a head disposed in said cylinder portion adjacent said rear portion,
said piston having a barrel disposed both in said cylinder portion and in said flange, (c) means to provide a metal-to-metal seal between said head and said cylindrical internal wall of said cylinder portion during substantially all portions of forward movement of said piston,
said means (c) to provide a metal-to-metal seal between said head and said cylindrical internal wall of said cylinder portion comprising a seal portion of said head adjacent said combination pyrotechnic and piston-insertion means,
said seal portion being thin-walled and formed of springy metal,
said seal portion being in resilient engagement with the internal wall of said cylinder portion during the forward movement of said piston resulting from detonation of the explosive
said cylinder portion of said housing having an internal groove,
said internal groove having a generally radial rearsd wall,
said internal groove being sized to receive a part of said head said piston is in full-forward position, (d) a combination pyrotechnic and piston-insertion means mounted in said rear portion of said housing,
said combination pyrotechnic and piston-insertion means being adapted to push said head into said cylinder portion during assembly of the device,
said combination pyrotechnic and piston-insertion means containing an explosive and a means to detonate said explosive, and (e) means to prevent said combination pyrotechnic and piston-insertion mans from moving rearwardly as the result of detonation of said explosive.

* * * * *